US010713992B2

(12) United States Patent
Morita

(10) Patent No.: US 10,713,992 B2
(45) Date of Patent: Jul. 14, 2020

(54) DISPLAY DRIVER, ELECTRO-OPTICAL DEVICE, AND ELECTRONIC APPARATUS

(71) Applicant: SEIKO EPSON CORPORATION, Tokyo (JP)

(72) Inventor: Akira Morita, Chino (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/518,423

(22) Filed: Jul. 22, 2019

(65) Prior Publication Data

US 2020/0027384 A1 Jan. 23, 2020

(30) Foreign Application Priority Data

Jul. 23, 2018 (JP) ..... 2018-137462

(51) Int. Cl.
*G09G 3/20* (2006.01)

(52) U.S. Cl.
CPC ..... *G09G 3/20* (2013.01); *G09G 2310/0289* (2013.01); *G09G 2330/028* (2013.01)

(58) Field of Classification Search
CPC ..... G09G 3/20; G09G 3/3696; G09G 2310/0264; G09G 2310/027; G09G 2310/0289; G09G 2310/0291; G09G 2330/028
See application file for complete search history.

(56) References Cited

U.S. PATENT DOCUMENTS 6,014,122 A 1/2000 Hashimoto
6,750,839 B1 * 6/2004 Hogan ..... G09G 3/3688 345/89
7,800,562 B2 * 9/2010 Asano ..... G09G 3/3208 345/77
9,270,112 B2 * 2/2016 Huang ..... G09G 3/20
2002/0063674 A1 * 5/2002 Chiang ..... G09G 3/2011 345/98
2002/0126106 A1 9/2002 Naito
2004/0189574 A1 * 9/2004 Lee ..... G09G 3/3696 345/95

(Continued)

FOREIGN PATENT DOCUMENTS

JP H04-055889 A 2/1992
JP H10-260664 A 9/1998

(Continued)

*Primary Examiner* — Ricardo Osorio
(74) *Attorney, Agent, or Firm* — Oliff PLC

(57) ABSTRACT

A display driver includes a first D/A converter circuit configured to output a gradation voltage corresponding to upper-bit data of display data, a second D/A converter circuit configured to output a reference voltage corresponding to lower-bit data of the display data, and an inverting amplifier circuit configured to amplify the gradation voltage with reference to the reference voltage, and to drive a data line of an electro-optical panel. The second D/A converter circuit includes a first resistor provided between a node of a high potential-side power source and an output node of the reference voltage, a second resistor provided between the output node and a first node, a reference voltage ladder resistance circuit provided between the first node and a node of a low potential-side power source, and a switch circuit.

10 Claims, 9 Drawing Sheets

(56) References Cited

U.S. PATENT DOCUMENTS

| | | | | |
|---|---|---|---|---|
| 2004/0212574 | A1* | 10/2004 | Iwasaki | G09G 3/3696 345/87 |
| 2005/0231409 | A1* | 10/2005 | Yamaguchi | G09G 3/3208 341/144 |
| 2006/0132344 | A1 | 6/2006 | Ishii et al. | |
| 2007/0040855 | A1* | 2/2007 | Kato | G09G 3/3688 345/690 |
| 2007/0126689 | A1 | 6/2007 | Ishii et al. | |
| 2008/0303770 | A1 | 12/2008 | Oke et al. | |
| 2009/0015297 | A1* | 1/2009 | Chen | H03K 19/0016 327/108 |
| 2010/0321370 | A1* | 12/2010 | Weng | G09G 3/3688 345/212 |
| 2013/0342520 | A1 | 12/2013 | Tsuchi | |
| 2015/0049073 | A1 | 2/2015 | Morita | |
| 2016/0111035 | A1 | 4/2016 | Morita | |
| 2016/0133218 | A1 | 5/2016 | Morita | |
| 2016/0133219 | A1 | 5/2016 | Morita | |

FOREIGN PATENT DOCUMENTS

| | | | |
|---|---|---|---|
| JP | 2001-067047 | A | 3/2001 |
| JP | 2005-292856 | A | 10/2005 |
| JP | 2006-197532 | A | 7/2006 |
| JP | 2007-158810 | A | 6/2007 |
| JP | 2007-219091 | A | 8/2007 |
| JP | 2008-065301 | A | 3/2008 |
| JP | 2008-304806 | A | 12/2008 |
| JP | 2015-038543 | A | 2/2015 |
| JP | 2016-080807 | A | 5/2016 |
| JP | 2016-090881 | A | 5/2016 |
| JP | 2016-090882 | A | 5/2016 |
| JP | 2017-156769 | A | 9/2017 |
| WO | 2012/121087 | A1 | 9/2012 |

* cited by examiner

| | RESISTANCE VALUE [Ω] |
|---|---|
| RR1 | 7420 |
| RR2 | 7420 |
| RLD1 | 10 |
| RLD2 | 10 |
| RLD3 | 10 |
| RLD4 | 10 |
| RLD5 | 10 |
| RLD6 | 10 |
| RLD7 | 10 |
| RLD8 | 10 |
| RLD9 | 10 |
| RLD10 | 10 |
| RLD11 | 10 |
| RLD12 | 10 |
| RLD13 | 10 |
| RLD14 | 10 |
| RLD15 | 10 |

FIG. 6

| | Vref[V] | Step[mV] |
|---|---|---|
| TS0 | 7.5 | |
| TS1 | 7.505 | 5 |
| TS2 | 7.51 | 5 |
| TS3 | 7.515 | 5 |
| TS4 | 7.52 | 5 |
| TS5 | 7.525 | 5 |
| TS6 | 7.53 | 5 |
| TS7 | 7.535 | 5 |
| TS8 | 7.54 | 5 |
| TS9 | 7.545 | 5 |
| TS10 | 7.55 | 5 |
| TS11 | 7.555 | 5 |
| TS12 | 7.56 | 5 |
| TS13 | 7.565 | 5 |
| TS14 | 7.57 | 5 |
| TS15 | 7.575 | 5 |

FIG. 7

DISPLAY DRIVER, ELECTRO-OPTICAL DEVICE, AND ELECTRONIC APPARATUS

The present application is based on and claims priority from JP Application Serial Number 2018-137462, filed Jul. 23, 2018, the disclosure of which is hereby incorporated by reference herein in its entirety.

BACKGROUND

1. Technical Field

The present disclosure relates to a display driver, an electro-optical device, and an electronic apparatus.

2. Related Art

A display driver configured to drive an electro-optical panel includes a ladder resistance circuit configured to generate a plurality of voltages, a digital-to-analog (D/A) converter circuit configured to select a gradation voltage corresponding to display data from the plurality of voltages, and an amplifier circuit configured to amplify or buffer (execute impedance conversion on) the gradation voltage. A related technology of such a display driver is disclosed in, for example, JP-A-2005-292856, JP-A-2001-67047, and JP-A-10-260664.

In JP-A-2005-292856, the amplifier circuit is formed of a non-inverting amplifier circuit. That is, a gradation voltage is input to a non-inverting input terminal (positive terminal) of an operational amplifier, and a feedback voltage is input to an inverting input terminal (negative terminal).

In JP-A-2001-67047 and JP-A-10-260664, the amplifier circuit is formed of an inverting amplifier circuit. A first capacitor is provided between an input node of the inverting amplifier circuit and an inverting input terminal of an operational amplifier. A second capacitor is provided between the inverting input terminal and an output terminal of the operational amplifier. A gradation voltage is input to a non-inverting input terminal of the operational amplifier.

Displaying in multiple gradation levels is occasionally required for a high-performance display device such as a projector. Voltage difference per one gradation, made small when displaying in multiple gradation levels, needs to be output with high precision. When an inverting amplifier circuit is used as an amplifier circuit, a technique is conceivable in which a first D/A converter circuit that outputs a gradation voltage to the inverting amplifier circuit, and a second D/A converter circuit that outputs a reference voltage of the inverting amplifier circuit are provided. In this technique, the second D/A converter circuit changes the reference voltage, and thus one gradation of the first D/A converter circuit is further divided, and a gradation voltage in multiple gradations is achieved.

At this time, since a breakdown voltage equivalent to that of the amplifier circuit is required in the switch circuit included in the second D/A converter circuit, there is a problem in that a layout area of the switch circuit is increased. In other words, since the amplifier circuit is formed of a transistor having a breakdown voltage higher than that of a logic circuit and the like, the layout area of the second D/A converter circuit is increased by requiring a breakdown voltage equivalent to the amplifier circuit.

SUMMARY

One aspect of the present disclosure is related to a display driver including a first D/A converter circuit configured to convert upper-bit data of display data into a gradation voltage corresponding to the upper-bit data, a second D/A converter circuit configured to output a reference voltage that is varied in accordance with lower-bit data of the display data, and an inverting amplifier circuit configured to amplify the gradation voltage with reference to the reference voltage, and to drive a data line of an electro-optical panel. The second D/A converter circuit includes a first resistor provided between a node of a high potential-side power source and an output node of the reference voltage, a second resistor provided between the output node and a first node, a reference voltage ladder resistance circuit provided between the first node and a node of a low potential-side power source, and a switch circuit including a plurality of switch elements provided between a plurality of output taps of the reference voltage ladder resistance circuit and the node of the low potential-side power source, the plurality of switch elements being turned on or off in accordance with the lower-bit data.

BRIEF DESCRIPTION OF THE DRAWINGS

FIG. 6 is an example of a resistance value in the second D/A converter circuit.

FIG. 7 is a reference voltage when each switch is turned on in an example of a resistance value in the second D/A converter circuit.

DESCRIPTION OF EXEMPLARY EMBODIMENTS

Exemplary embodiments of the present disclosure will be described in detail hereinafter. Note that the exemplary embodiments described hereinafter are not intended to limit the content of the present disclosure as set forth in the claims, and not all of the configurations described in the exemplary embodiments are absolutely required to address the issues described in the present disclosure.

1. Configuration Example of Display Driver

Figure 1:
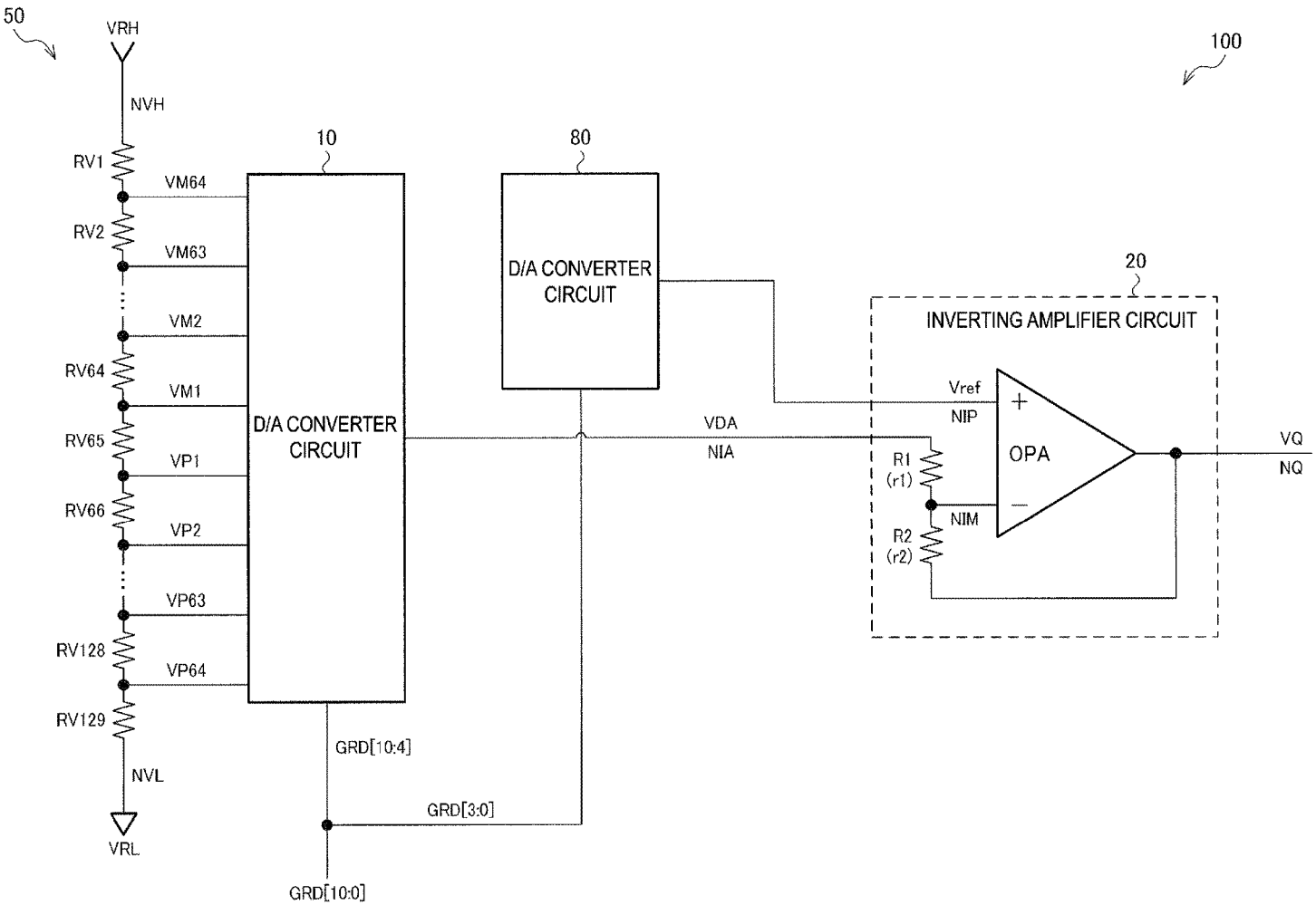
FIG. 1 illustrates a configuration example of a display driver.

FIG. 1 illustrates a configuration example of a display driver 100. The display driver 100 includes a D/A converter circuit 10, an inverting amplifier circuit 20, and a D/A converter circuit 80. The display driver 100 may further include a ladder resistance circuit 50. The D/A converter circuit 10 is a first D/A converter circuit. The D/A converter circuit 80 is a second D/A converter circuit. The display driver 100 is, for example, an integrated circuit device.

Display data are n+m bits of data. Hereinafter, n bits of data from the most significant bit (MSB) side is referred to as upper-bit data and m bits of data from the least significant bit (LSB) side is referred to as lower-bit data. In FIG. 1, display data GRD [10:0] are 11 bits of data, upper-bit data GRD [10:4] are 7 bits of data, and lower-bit data GRD [3:0] are 4 bits of data. It is noted that n and m may each be, not limited to the above, an integer equal to or greater than 1.

The D/A converter circuit 10 converts the upper-bit data GRD [10:4] of the display data into a gradation voltage VDA. The gradation voltage VDA is a voltage corresponding to the upper-bit data GRD [10:4]. In other words, the D/A converter circuit 10 selects a voltage corresponding to the upper-bit data GRD [10:4] from a plurality of voltages VP1 to VP64 and VM1 to VM64 and outputs the selected voltage as the gradation voltage VDA. Specifically, when GRD [10:4]=0000000, 0000001, . . . , or 0111111, respective negative driving voltages VM64, VM63, . . . , or VM1 are output as the gradation voltage VDA. When GRD [10:4]=1000000, 1000001, . . . , or 1111111, respective positive driving voltages VP1, VP2, . . . , or VP64 are output as the gradation voltage VDA. Note that GRD [10:4] is expressed in binary herein. In polarity inversion driving that inverts a drive polarity for every pixel, line, or frame, the positive driving voltages VP1 to VP64 are selected for positive driving, and the negative driving voltages VM1 to VM64 are selected for negative driving.

For example, the D/A converter circuit 10 is formed of a decoder configured to decode the upper-bit data GRD [10:4] and a switch circuit controlled by the decoder. The switch circuit includes a plurality of switches, selects either one of the voltages VM64 to VM1 or VP1 to VP64 when each switch is turned on or off, and outputs the selected voltage as the gradation voltage VDA. The switch is, for example, a transistor. The decoder decodes the upper-bit data GRD [10:4] into an enable signal for selecting the voltage corresponding to the upper-bit data GRD [10:4]. The enable signal is used to control the plurality of switches of the switch circuit to be turned on or off, and the voltage corresponding to the upper-bit data GRD [10:4] is selected by the switch circuit.

The inverting amplifier circuit 20 amplifies the gradation voltage VDA with reference to a reference voltage Vref, and drives a data line of the electro-optical panel. In other words, the inverting amplifier circuit 20 outputs an output voltage VQ obtained by amplifying the gradation voltage VDA as a data voltage from a data voltage output terminal of the display driver 100 to a data line of the electro-optical panel. Provided that a gain of the inverting amplifier circuit 20 is G, the inverting amplifier circuit 20 inverts and amplifies the gradation voltage VDA with the gain G with reference to the reference voltage Vref, and outputs the output voltage VQ (data voltage). G<0. The output voltage VQ is output as a data voltage from a terminal of the display driver 100 and drives a data line of the electro-optical panel coupled to the display driver 100. For example, VP64<VP63< . . . <VP1<VM1<VM2< . . . <VM64. The negative driving voltages VM1 to VM64 are inverted and amplified to be negative data voltages that are lower than the reference voltage Vref. The positive drive voltages VP1 to VP64 are inverted and amplified to be positive data voltages that are higher than the reference voltage Vref.

The inverting amplifier circuit 20 includes an operational amplifier OPA, a resistor R1, and a resistor R2. The resistor R1 is a first resistor. The resistor R2 is a second resistor. The reference voltage Vref is input from the D/A converter circuit 80 to a non-inverting input terminal of the operational amplifier OPA. The non-inverting input terminal is a positive terminal and is coupled to a non-inverting input node NIP. The resistor R1 is provided between an input node NIA, to which the gradation voltage VDA is input, and an inverting input terminal of the operational amplifier OPA. The inverting input terminal is a negative terminal and is coupled to an inverting input node NIM. The resistor R2 is provided between an output terminal of the operational amplifier OPA and the inverting input terminal of the operational amplifier OPA. The output terminal is coupled to an output node NQ. A voltage obtained by dividing a voltage between the gradation voltage VDA and the output voltage VQ by the resistors R1 and R2, is input to the inverting input terminal of the operational amplifier OPA. The gain of the inverting amplifier circuit 20 is represented by G=−r2/r1 wherein the resistors R1 and R2 respectively have resistance values r1 and r2.

The D/A converter circuit 80 outputs a reference voltage Vref that is varied in accordance with the lower-bit data GRD [3:0] of the display data to the non-inverting input terminal of the operational amplifier OPA. The gradation voltage VDA with respect to predefined upper-bit data GRD [10:4] is input to the input node NIA of the inverting amplifier circuit 20. At this time, the output voltage VQ of the inverting amplifier circuit 20 is varied in accordance with the variation of the reference voltage Vref. When a voltage change per one gradation in the output voltage VQ is defined as ΔVQ, ΔVQ is defined as being divided into $2^4$. The D/A converter circuit 80 generates $2^4$ voltages corresponding to $2^4$ division voltages on the output voltage VQ side. The D/A converter circuit 80 outputs, as the reference voltage Vref, the voltage corresponding to the lower-bit data GRD [3:0] among the $2^4$ voltages. This causes the output voltage VQ corresponding to the display data GRD [10:0] including the lower-bit data GRD [3:0] to be output. A detailed configuration of the D/A converter circuit 80 will be described later. Note that the D/A converter circuit 80 may generate $2^m$ voltages, and ΔVQ may be divided into $2^m$. m is an integer equal to or greater than 1.

Figure 2:
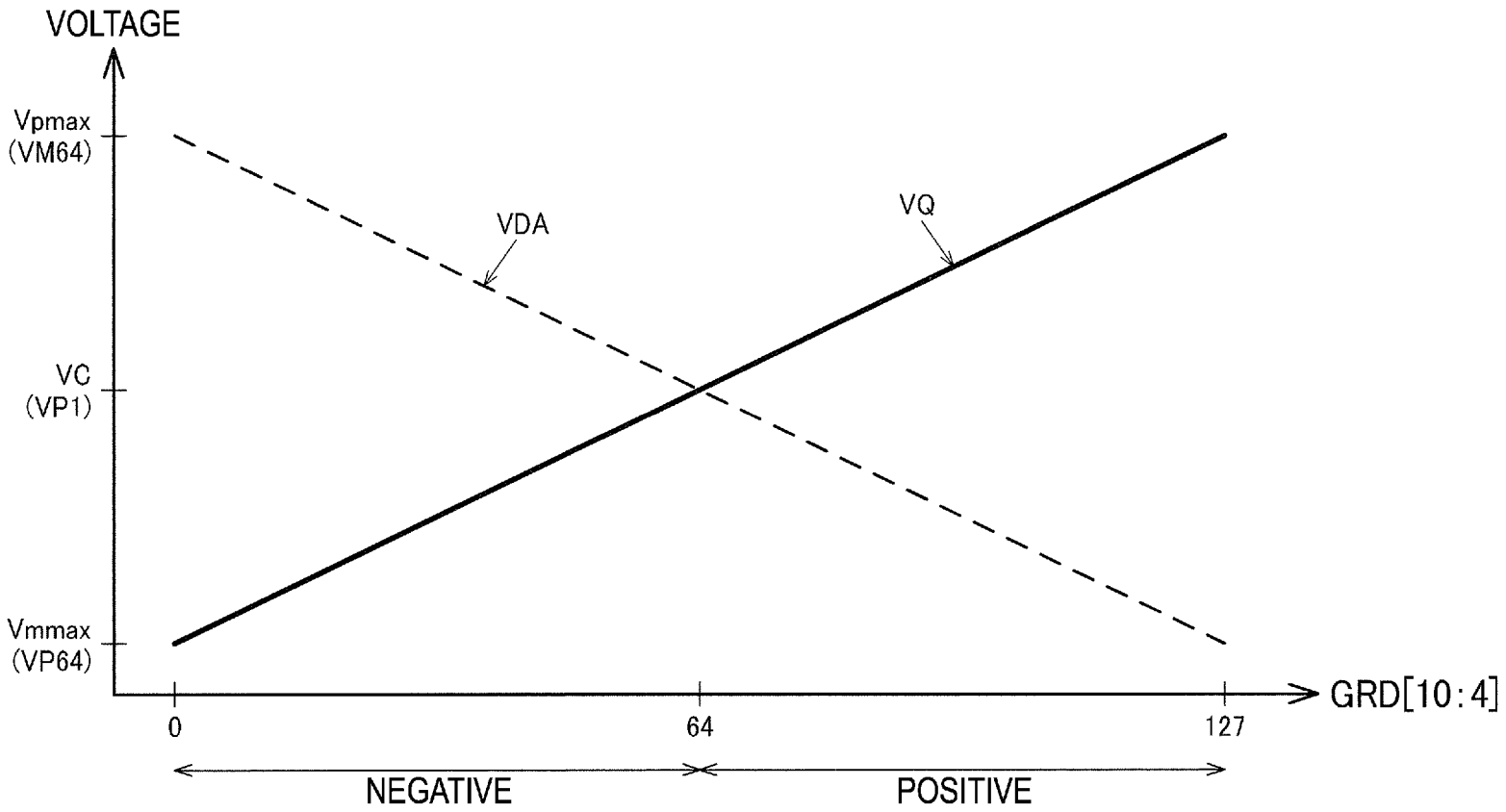
FIG. 2 is a diagram for describing an operation of the display driver.
Figure 3:
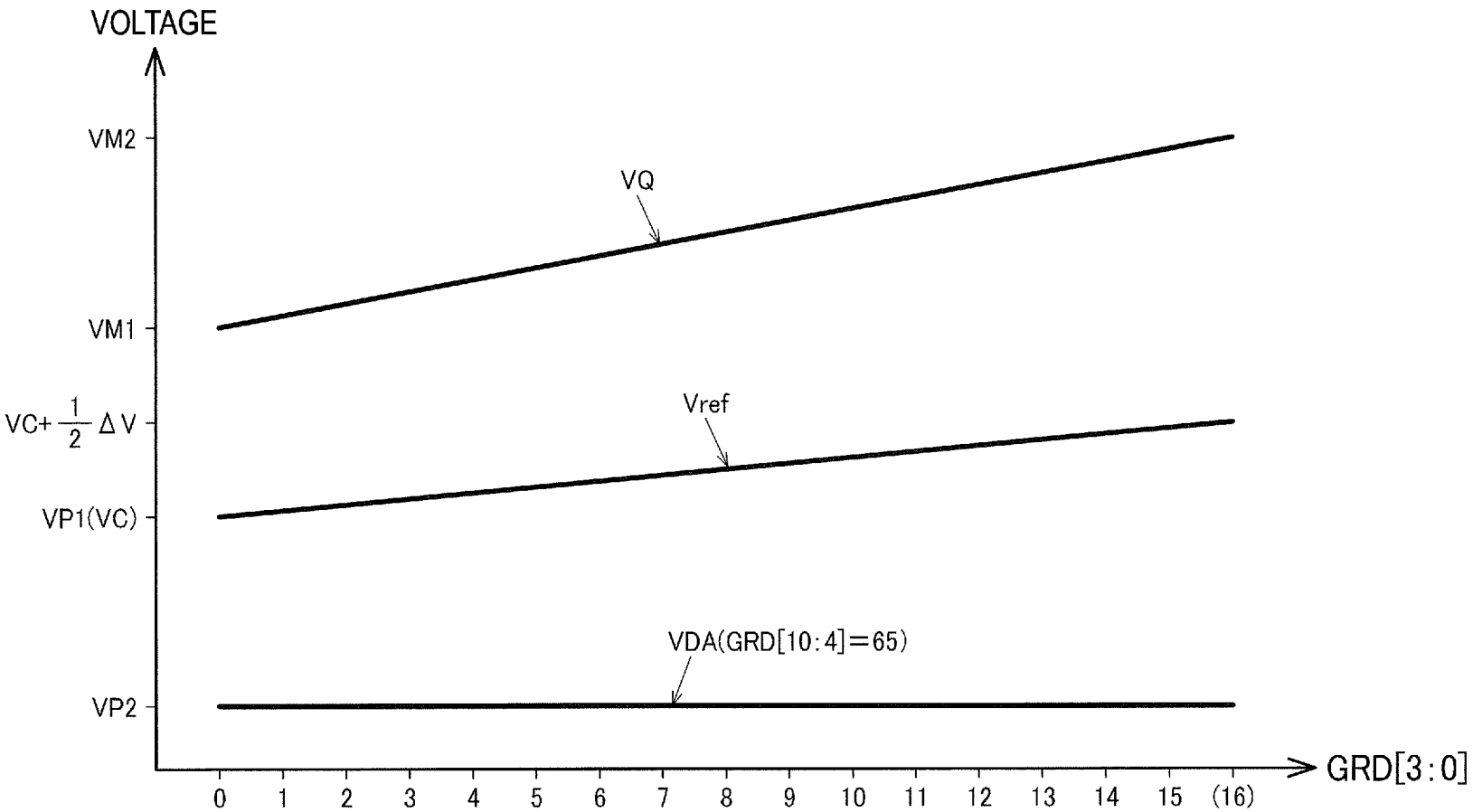
FIG. 3 is a diagram for describing an operation of the display driver.

FIGS. 2 and 3 are diagrams for describing an operation of the display driver 100. In FIGS. 2 and 3, a gradation value of the upper-bit data GRD [10:4] and a gradation value of the lower-bit data GRD [3:0] are both represented by decimal numbers. In addition, a case where the gain of the inverting amplifier circuit 20 is −1 (i.e., r1=r2) will be described as an example. Note that the gain of the inverting amplifier circuit 20 is not limited to −1.

FIG. 2 illustrates voltage characteristics when the upper-bit data GRD [10:4] are varied. In FIG. 2, the lower-bit data are set such that GRD [3:0]=0.

As illustrated in FIG. 2, the gradation voltage VDA varies linearly, for example, with respect to a gradation value of GRD [10:4]. When GRD [10:4]=0, VDA=VPmax. When GRD [10:4]=64, VDA=VC. When GRD [10:4]=127, VDA=VMmax=VP64. For a data voltage after an inverting amplification, when GRD [10:4]=0, VQ=VMmax, when GRD [10:4]=64, VQ=VC, and when GRD [10:4]=127, VQ=VPmax. Therefore, VQ<VC<VDA in negative gradations having gradation values of "0" to "63", and VQ≥VC≥VDA in positive gradations having gradation values of "64" to "127". Note that VPmax is the maximum gradation voltage of the positive polarity and VMmax is the maximum gradation voltage of the negative polarity. The maximum gradation voltage is a gradation voltage farthest from VC. Also note that VC is the reference voltage Vref when the lower-bit data GRD [3:0]=0, and VC=(VPmax+VMmax)/2. VC is, for example, a common voltage supplied to a common electrode of the electro-optical panel. Correspondences with the output voltage of the ladder resistance circuit 50 in FIG. 1 are represented by VPmax=VM64, VMmax=VP64, and VC=VP1.

FIG. 3 illustrates voltage characteristics when the lower-bit data GRD [3:0] is varied. Here, a case where the upper-bit data GRD [10:4]=65 and VDA=VP2 will be described as an example. Note that, although GRD [3:0] actually ranges from 0 to 15, illustrations are up to 16 for descriptive purposes.

When GRD [3:0]=0, the D/A converter circuit 80 outputs the reference voltage Vref=VC=VP1. Since the inverting amplifier circuit 20 amplifies the gradation voltage VDA=VP2 with the gain of −1 with reference to the reference voltage Vref, the output voltage VQ=VM1. When the upper-bit data GRD [10:4]=66 on a one step higher gradation level, VQ=VM2 for the output voltage of the inverting amplifier circuit 20. Thus, when GRD [3:0]=16, it may be that Vref=(VP2+VM2)/2=VC+(VM1−VP1)/2. Vref=VC+(½)×ΔV wherein ΔV=VM1−VP1. By equally dividing the voltage which is linearly varied from VC to VC+(½)×ΔV by $2^4$, each gradation of the GRD [3.0] becomes the reference voltage Vref. In other words, the D/A converter circuit 80 outputs the reference voltage Vref=VC+i×{(½)×ΔV/$2^4$} wherein GRD [3:0]=i. i is an integer from 0 to 15. For the output voltage of the inverting amplifier circuit 20, VQ=VM1+i×(ΔV/$2^4$), which is a voltage obtained by equally dividing the voltage between VM1 and VM2 by $2^4$.

Note that, although the case where the inverting amplifier circuit 20 having a gain G=−1 is exemplified as above, the reference voltage when GRD [3:0]=16 may be represented, for any gain G<0, by Vref=VC+ΔV×|G|/(1+|G|). In other words, the D/A converter circuit 80 outputs the reference voltage Vref=VC+i×{ΔV×|G|/(1+|G|)/$2^4$}.

Figure 8:
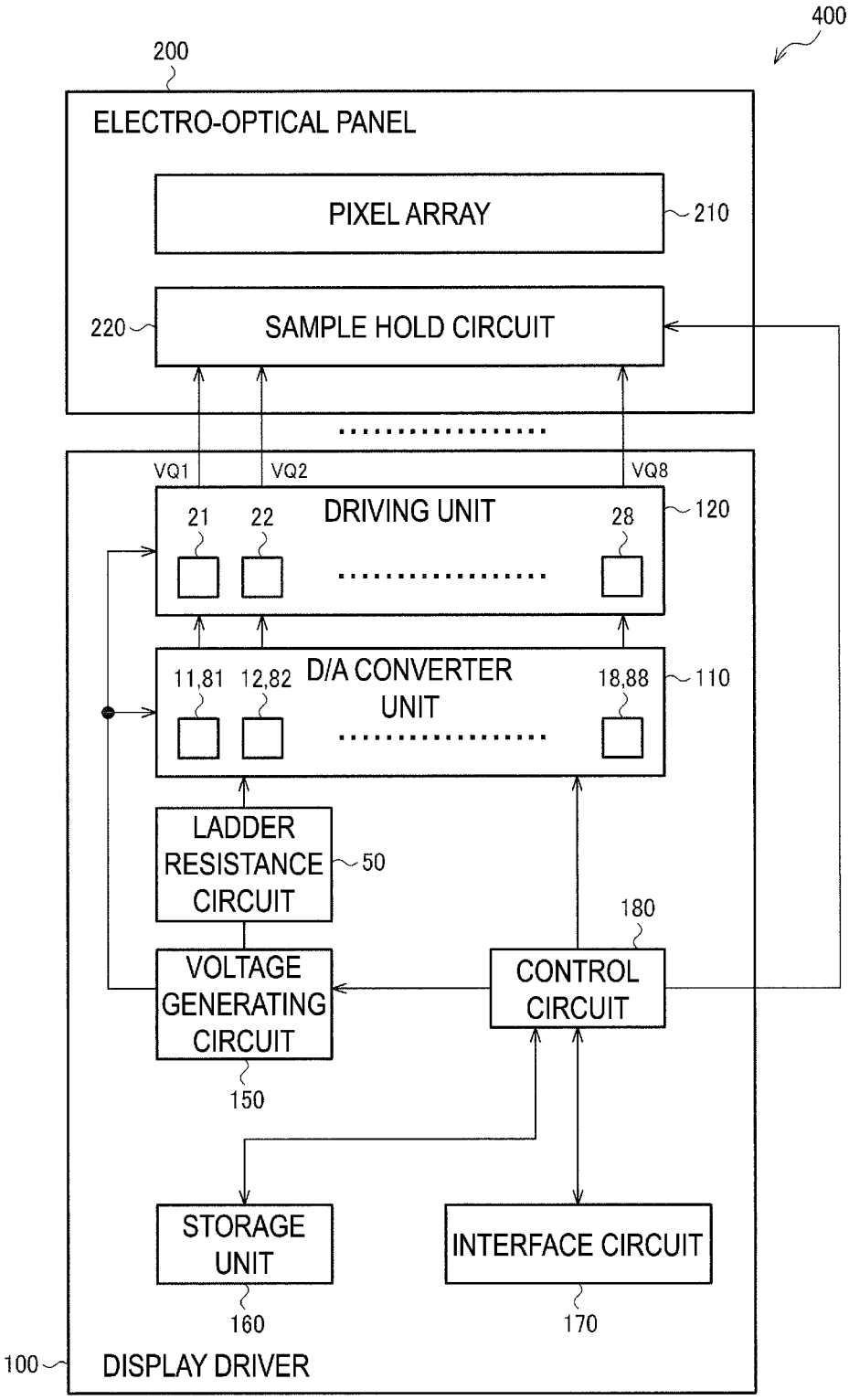
FIG. 8 illustrates a configuration example of an electro-optical device.

As described above, the D/A converter circuit 80 outputs the reference voltage Vref to the inverting amplifier circuit 20. In a case where the D/A converter circuit 80 is formed by a known technique, for example, the following configuration is considered. In other words, the D/A converter circuit 80 includes a ladder resistance circuit and a switch circuit that selects an output tap of the ladder resistance circuit in accordance with the lower-bit data GRD [3:0]. For example, a control circuit 180 in FIG. 8 is a logic circuit, and the control circuit 180 outputs the lower-bit data GRD [3:0] to the D/A converter circuit 80. The inverting amplifier circuit 20 has a power source voltage higher than a power source voltage of the logic circuit to drive the electro-optical panel. Thus, the switch circuit of the D/A converter circuit 80 that outputs the reference voltage Vref to the inverting amplifier circuit 20 requires a breakdown voltage higher than that of the logic circuit, and the switch circuit needs to be formed of a transistor or the like having a breakdown voltage higher than that of the logic circuit. In addition, since the power source voltage of the control circuit 180 and the power source voltage of the switch circuit are different, a level shifter is needed. As a result, there is a problem in that a circuit scale, i.e., a layout area, of the D/A converter circuit 80 is increased when the D/A converter circuit 80 is formed by a known technique.

2. Detailed Examples of Configuration

The D/A converter circuit 80 according to the exemplary embodiment that can solve the problem as described above will be described by using FIGS. 4 to 7.

Figure 4:
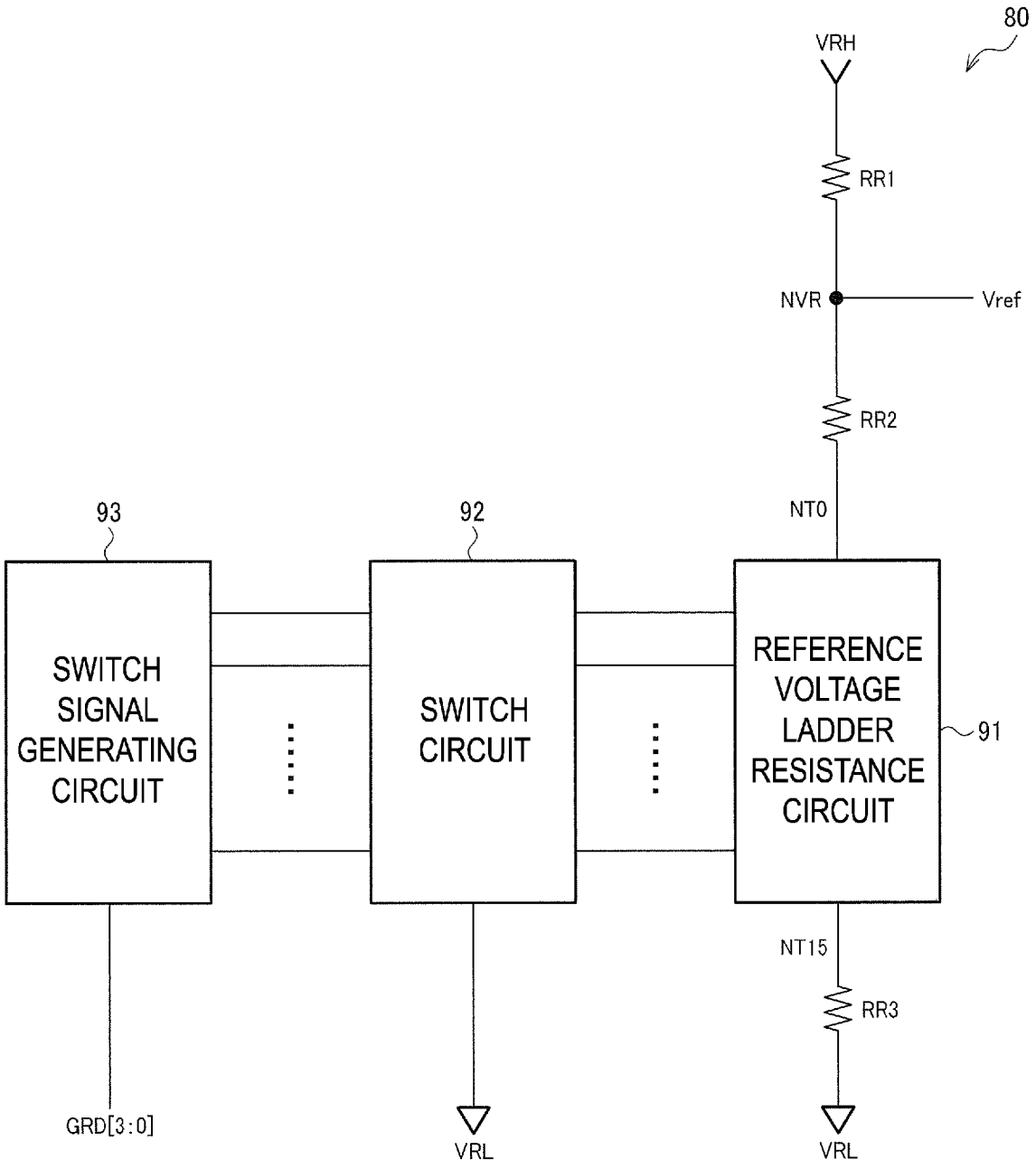
FIG. 4 is a detailed example of a configuration of a second D/A converter circuit.

FIG. 4 is a detailed example of a configuration of the D/A converter circuit 80. The D/A converter circuit 80 includes resistors RR1 to RR3, a reference voltage ladder resistance circuit 91, a switch circuit 92, and a switch signal generating circuit 93. The resistor RR1 is a first resistor. The resistor RR2 is a second resistor. The resistor RR3 is a third resistor.

The resistor RR1 is provided between a node of a high potential-side power source VRH and an output node NVR of the reference voltage Vref. In other words, one end of the resistor RR1 is coupled to the node of the high potential-side power source VRH, and the other end of the resistor RR1 is coupled to the output node NVR. The output node NVR is coupled to the non-inverting input node NIP in FIG. 1.

The resistor RR2 is provided between the output node NVR and a node NT0. In other words, one end of the resistor RR2 is coupled to the output node NVR, and the other end of the resistor RR2 is coupled to the node NT0. The node NT0 is a first node.

The reference voltage ladder resistance circuit 91 is provided between the node NT0 and a node of a low potential-side power source VRL. Specifically, the reference voltage ladder resistance circuit 91 and the resistor RR3 are coupled in series between the node NT0 and the node of the low potential-side power source VRL. One end of the reference voltage ladder resistance circuit 91 is coupled to the node NT0, and the other end of the reference voltage ladder resistance circuit 91 is coupled to a node NT15. One end of the resistor RR3 is coupled to the node NT15, and the other end of the resistor RR3 is coupled to the node of the low potential-side power source VRL. Note that the resistor RR3 may be omitted. In this case, the node NT15 is the node of the low potential-side power source VRL.

The switch circuit 92 includes a plurality of switch elements provided between a plurality of output taps of the reference voltage ladder resistance circuit 91 and the node of the low potential-side power source VRL. The plurality of switch elements are turned on or off in accordance with the lower-bit data GRD [3:0]. The output tap is a node between resistors at a ladder resistance.

The switch signal generating circuit 93 outputs a switch signal based on data in accordance with the lower-bit data GRD [3:0]. The switch signal is a signal for turning on or off the plurality of switch elements of the reference voltage ladder resistance circuit 91. In FIG. 4, the switch signal generating circuit 93 outputs a switch signal based on the lower-bit data GRD [3:0], which is not limited to this. In other words, the data in accordance with the lower-bit data GRD [3:0] may be lower-bit data GRD [3:0] itself, or may be data obtained by processing the lower-bit data GRD [3:0].

The switch signal generating circuit 93 turns on a switch in accordance with the lower-bit data GRD [3:0] among the plurality of switches, and turns off the other switches. As a result, an output tap selected by the lower-bit data GRD [3:0] is coupled to the node of the low potential-side power source VRL. The resistors RR1 to RR3 and the reference voltage ladder resistance circuit 91 are a voltage dividing circuit that outputs the reference voltage Vref. The output tap is selected by the lower-bit data GRD [3:0], and thus voltage division ratio changes. As a result, the reference voltage Vref varies in accordance with the lower-bit data GRD [3:0].

According to the exemplary embodiment described above, the display driver 100 includes the D/A converter circuit 10 that converts the upper-bit data GRD [10:4] of the display data into the gradation voltage VDA, and the D/A converter circuit 80 that outputs the reference voltage Vref that is varied in accordance with the lower-bit data GRD [3:0] of the display data. The display driver 100 further includes the inverting amplifier circuit 20 that amplifies the gradation voltage VDA with reference to the reference voltage Vref. The D/A converter circuit 80 includes the resistor RR1, the resistor RR2, the reference voltage ladder resistance circuit 91, and the switch circuit 92. The switch circuit 92 includes a plurality of switch elements provided between a plurality of output taps of the reference voltage ladder resistance circuit 91 and a node of the low potential-side power source VRL. The plurality of switch elements are turned on or off in accordance with the lower-bit data GRD [3:0].

At this time, the resistor RR1 is provided between the node of the high potential-side power source VRH and the output node NVR of the reference voltage Vref. The resistor RR2 is provided between the output node NVR and the node NT0. The reference voltage ladder resistance circuit 91 is provided between the node NT0 and the node of the low potential-side power source VRL. According to the exemplary embodiment, a voltage obtained by dividing a voltage between the reference voltage Vref and the low potential-side power source VRL with the resistor RR2 and the reference voltage ladder resistance circuit 91, is a voltage of the node NT0. In other words, the voltage of the node NT0 is a voltage lower than the reference voltage Vref. As a result, the switch circuit 92 and the switch signal generating circuit 93 can be formed in a low breakdown voltage process by setting the voltage of the node NT0 to be lower than the power source voltage of the logic circuit. The low breakdown voltage process is a process of a breakdown voltage lower than a breakdown voltage of a process of forming the inverting amplifier circuit 20. The switch circuit 92 and the switch signal generating circuit 93 can be formed in the low breakdown voltage process, and thus a layout area of the D/A converter circuit 80 can be reduced.

Note that, by providing the inverting amplifier circuit 20, the D/A converter circuit 10, and the D/A converter circuit 80, the following effects can be obtained. In other words, according to the exemplary embodiment, the D/A converter circuit 80 outputs the reference voltage Vref that is varied in accordance with the lower-bit data GRD [3:0] of the display data, and thus the output voltage VQ of the inverting amplifier circuit 20 can be varied in accordance with the lower-bit data GRD [3:0]. As a result, each gradation of the upper-bit data GRD [10:4] is further divided with the lower-bit data GRD [3:0], and the number of gradations can be increased. For example, the voltage difference of one gradation decreases when the number of gradations is to be increased using only the ladder resistance circuit 50 and the D/A converter circuit 10, thus making it difficult to obtain a high-precision gradation voltage or enlarging the circuit scale of the D/A converter circuits. In this regard, the reference voltage Vref is varied to divide each gradation of the upper-bit data GRD [10:4], and this enables multiple gradations to be achieved while suppressing the circuit scale of the D/A converter circuit.

Figure 5:
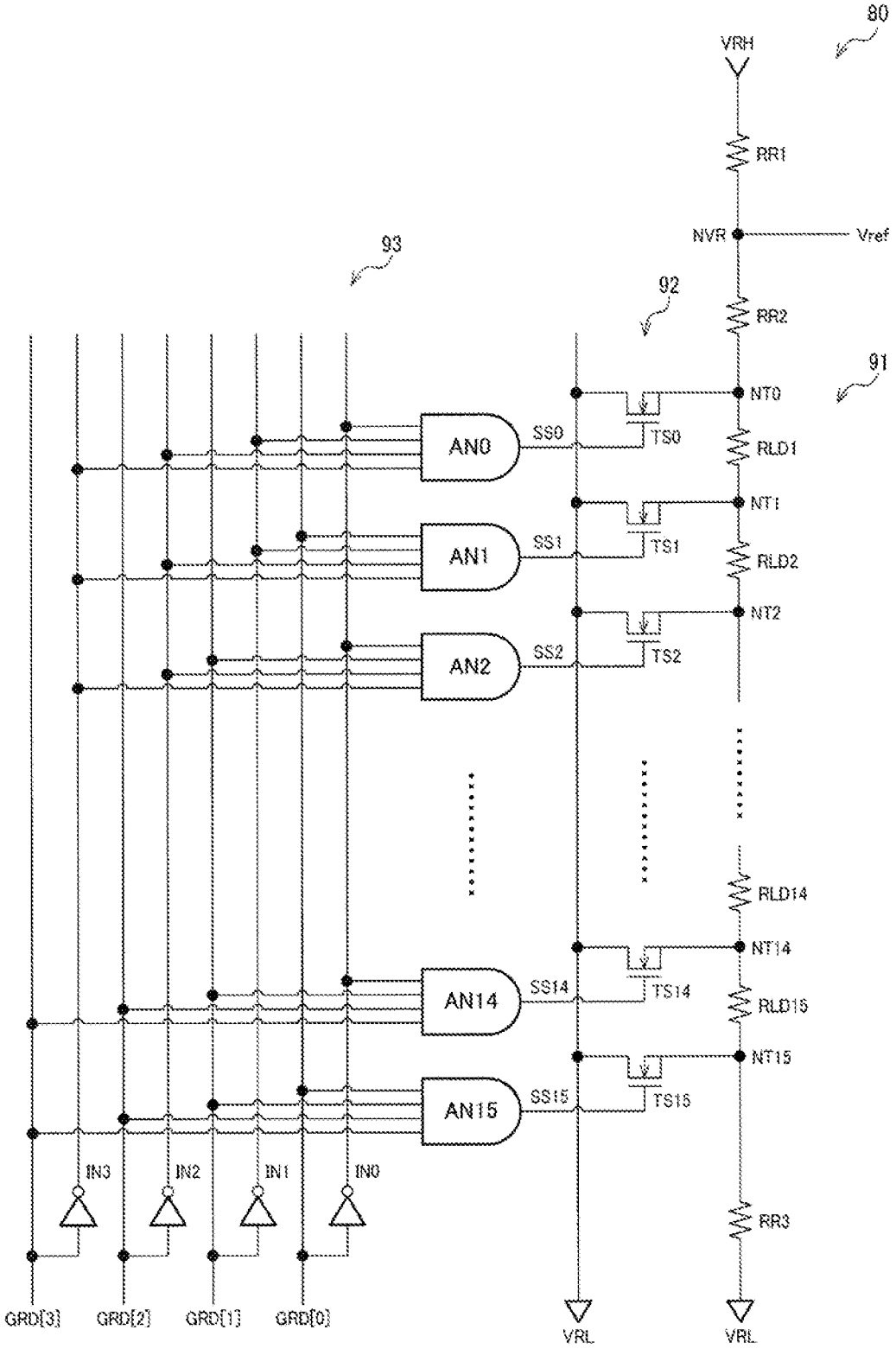
FIG. 5 is a detailed example of a configuration of a reference voltage ladder resistance circuit, a switch circuit, and a switch signal generating circuit.

FIG. 5 is a detailed example of the configuration of the reference voltage ladder resistance circuit 91, the switch circuit 92, and the switch signal generating circuit 93.

The reference voltage ladder resistance circuit 91 includes resistors RLD1 to RLD15 coupled in series between the node NT0 and the node NT15.

One end of the resistor RLD1 is coupled to the node NT0, and the other end of the resistor RLD1 is coupled to the node NT1. One end of the resistor RLD2 is coupled to the node NT1, and the other end of the resistor RLD2 is coupled to the node NT2. The same applies to the following. The nodes NT0 to NT15 are output taps of the reference voltage ladder resistance circuit 91. Note that, although FIG. 5 illustrates an example in which the output taps are 16, the number of output taps is not limited to this. The reference voltage ladder resistance circuit 91 may include a first to a k-th output taps. k is an integer equal to or greater than 2.

The switch circuit 92 includes transistors TS0 to TS15. The transistors TS0 to TS15 are switches. For example, the transistors TS0 to TS15 are N-type transistors. The D/A converter circuit 10 and the inverting amplifier circuit 20 are formed of a transistor having a first breakdown voltage, and the transistors TS0 to TS15 of the switch circuit 92 are transistors having a second breakdown voltage that is lower than the first breakdown voltage. The first breakdown voltage is higher than the power source voltage of the D/A converter circuit 10 and the inverting amplifier circuit 20. The second breakdown voltage is higher than the power source voltage of the switch circuit 92 and the switch signal generating circuit 93 and is lower than the first breakdown voltage. The breakdown voltage is a maximum voltage that can be applied to the circuit element. The breakdown voltage of the transistor is a maximum voltage that can be applied between terminals of the transistor. In other words, the breakdown voltage of the transistor is the maximum voltage that does not degrade or destroy insulation even when applied between terminals of the transistor.

A source of the transistor TS0 is coupled to the node NT0, and a drain of the transistor TS0 is coupled to the node of the low potential-side power source VRL. A source of the transistor TS1 is coupled to the node NT1, and a drain of the transistor TS1 is coupled to the node of the low potential-side power source VRL. The same applies to the following.

The switch signal generating circuit 93 includes NOT circuits IN0 to IN3 and circuits AN0 to AN15. The switch signal generating circuit 93 is formed of a transistor having the second breakdown voltage, similar to the switch circuit 92.

The NOT circuit IN0 outputs a logic inversion signal of a bit signal GRD [0]. Similarly, the NOT circuits IN1 to IN3 output logic inversion signals of bit signals GRD [1] to GRD [3]. Hereinafter, the logic inversion signals of GRD [0] to GRD [3] are described as XGRD [0] to XGRD [3].

The AND circuit AN0 outputs a logical product of XGRD [0], XGRD [1], XGRD [2], and XGRD [3] as a switch signal SS0. When GRD [3:0]=0000, SS0 is at a high level, and the transistor TS0 is turned on. At this time, SS1 to SS15 are at a low level, and the transistors TS1 to TS15 are turned off. The node NT0 is coupled to the node of the low potential-side power source VRL with the transistor TS0, and the node NT0 is in a voltage of the low potential-side power source VRL. The AND circuit AN1 outputs a logical product of XGRD [0], XGRD [1], XGRD [2], XGRD [3] as a switch signal SS1. When GRD [3:0]=0001, SS1 is at the high level, and the transistor TS1 is turned on. At this time, SS0 and SS2 to SS15 are at the low level, and the transistors TS0 and TS2 to TS15 are turned off. The node NT1 is coupled to the node of the low potential-side power source VRL with the transistor TS1, and the node NT1 is in a voltage of the low potential-side power source VRL. The same applies to the following, and when GRD [3:0]=0010, 0011, . . . , or 1111, the transistors TS2, TS3, . . . , or TS15 are turned on, respectively.

According to the exemplary embodiment described above, the switch signal generating circuit 93 outputs the switch signals SS0 to SS15 based on the lower-bit data GRD [3:0] to turn on or off the transistors TS0 to TS15. As a result, any of the nodes NT0 to NT15 being the output taps is selected in accordance with the lower-bit data GRD [3:0], and the selected output tap is coupled to the node of the low potential-side power source VRL. Since the reference voltage Vref is varied depending on which output tap is selected, the reference voltage Vref is controlled in accordance with the lower-bit data GRD [3:0].

FIG. 6 is an example of a resistance value in the D/A converter circuit 80. FIG. 6 illustrates a resistance value when the resistor RR3 is omitted. FIG. 7 illustrates the reference voltage Vref when each switch is turned on in the example of FIG. 6. Note that FIGS. 6 and 7 illustrate a schematic numerical value to simplify the description.

It is assumed in FIG. 6 that VRH=15 V and the minimum value of Vref is VRH/2. When the transistor TS0 is turned on, a voltage is divided by the resistors RR1 and RR2, resulting in Vref=7.5 V as illustrated in FIG. 7. When the transistor TS1 is turned on, a voltage is divided by the resistors RR1 as well as RR2 and RLD1, resulting in Vref=7.505 V as illustrated in FIG. 7. When the transistor TS2 is turned on, a voltage is divided by the resistors RR1 as well as RR2, RLD1, and RLD2, resulting in Vref=7.51 V as illustrated in FIG. 7. In other words, the reference voltage Vref is varied by a step of 5 mV per gradation. Since VRH=15 V, a voltage drop of 1 mV per 1Ω occurs in the example of FIG. 6. When the lower-bit data GRD [3:0] is varied by one gradation, a resistance value of the reference voltage ladder resistance circuit 91 is varied by 10Ω, and thus a voltage of the node NT0 is varied by 10 mV. This change of 10 mV changes the reference voltage Vref by 5 mV. Thus, the step of the reference voltage Vref per gradation is 5 mV.

In the example of FIG. 6, when the transistor TS15 is turned on, a voltage of the node NT0 reaches the maximum value of 150 mV. Provided that a power source voltage of the switch signal generating circuit 93 is VDL, resistance values of the resistors RR1, RR2, and RLD1 to RLD15 are predetermined such that the maximum voltage of the node NT0<VDL. In addition, when the resistor RR3 is further provided, resistance values of the resistors RR1 to RR3 and RLD1 to RLD15 are predetermined such that the maximum voltage of the node NT0<VDL. In this way, a breakdown voltage of the transistors TS0 to TS15 can be the same as a breakdown voltage of the transistor constituting the switch signal generating circuit 93. As described above, this breakdown voltage is lower than the breakdown voltage of the transistor constituting the inverting amplifier circuit 20.

Note that the minimum value of Vref may not be VRH/2. By adjusting the resistance values of the resistors RR1 and RR2, the minimum value of Vref can be adjusted.

Although the resistor RR3 is omitted above, characteristics of the reference voltage Vref for the lower-bit data GRD [3:0] can be improved by providing the resistor RR3. For example, the linearity of the reference voltage Vref with respect to the lower-bit data GRD [3:0] can be improved.

Specifically, the transistors TS0 to TS15 have an on resistance. Thus, when the resistor RR3 is not provided, the linearity of the reference voltage Vref may decrease due to the on resistance of the transistors TS0 to TS15. For example, when the transistor TS15 is turned on, a resistance between the node NT15 and the low potential-side power source VRL is an on resistance of the transistor TS15. When the transistor TS14 is turned on, a resistance between the node NT14 and the low potential-side power source VRL is a parallel resistance of the on resistance of the transistor TS14 and the resistor RLD15. As a result, an apparent on resistance varies depending on gradation, which causes the linearity of the reference voltage Vref to decrease.

On the other hand, with the resistor RR3 being provided, when the transistor TS15 is turned on, a resistance between the node NT15 and the low potential-side power source VRL is a parallel resistance of the on resistance of the transistor TS15 and the resistor RR3. When the transistor TS14 is turned on, a resistance between the node NT14 and the low potential-side power source VRL is a parallel resistance of the on resistance of the transistor TS14, and the resistor RLD15 and the resistor RR3. When a resistance value of the resistor RR3 is sufficiently greater than the on resistance of the transistor, a resistance value of the parallel resistance is substantially a resistance value of the on resistance of the transistor. As a result, an apparent on resistance can be fixed regardless of gradation, and the linearity of the reference voltage Vref can be improved.

3. Electro-optical Device and Electronic Apparatus

FIG. 8 illustrates an example of a configuration of an electro-optical device 400 including the display driver 100. The electro-optical device 400 includes the display driver 100 and an electro-optical panel 200. The electro-optical device 400 is also referred to as a display device. Note that a case where the display driver 100 executes phase development driving will be described as an example below. However, an application target of the present disclosure is not limited to this, and the present disclosure is also applicable to, for example, multiplex driving and the like.

The electro-optical panel 200 includes a pixel array 210 and a sample hold circuit 220. The electro-optical panel 200 is, for example, a liquid crystal display panel, an electro luminescence (EL) display panel, and the like.

The pixel array 210 includes a plurality of pixels disposed in an array. In the phase development driving, p source lines of the pixel array 210 are successively driven. p is an integer equal to or greater than 2. Hereinafter, p=8. The sample hold circuit 220 is a circuit that samples and holds data voltages VQ1 to VQ8 from the display driver 100 to the source lines of the pixel array 210. In other words, the data voltages VQ1 to VQ8 are respectively input to first to 8-th data lines of the electro-optical panel 200. It is assumed that the pixel array 210 includes first to 640-th source lines, for example. The sample hold circuit 220 couples the first to 8-th data lines to the first to 8-th source lines in a first period and couples the first to 8-th data lines to the 9-th to 16-th source lines in a next second period. The same applies to the following, and then the sample hold circuit 220 couples the first to 8-th data lines to the 633-th to 640-th source lines in the 80-th period. Such an operation is executed in each of the horizontal scanning periods.

The display driver 100 includes the ladder resistance circuit 50, a D/A converter unit 110, a driving unit 120, a voltage generating circuit 150, a storage unit 160, an interface circuit 170, and the control circuit 180.

The interface circuit 170 communicates between the display driver 100 and an external processing device. The processing device is, for example, a processing unit 310 in FIG. 9. For example, a clock signal, a timing enable signal, and display data are input from the external processing device to the control circuit 180 through the interface circuit 170.

The control circuit 180 controls each of the units of the display driver 100 and each of the units of the electro-optical panel 200, based on the clock signal, the timing enable signal, and the display data input through the interface circuit 170. For example, the control circuit 180 controls display timing, and then controls the D/A converter unit 110 and the sample hold circuit 220 according to the display timing. The control of the display timing is a selection of a horizontal scan line of the pixel array 210, vertical synchronization control of the pixel array 210, control of the phase development driving, and the like.

The voltage generating circuit 150 generates various voltages and outputs the voltage to the driving unit 120 and the D/A converter unit 110. For example, the voltage generating circuit 150 generates a power source of the D/A converter unit 110 and the driving unit 120. The voltage generating circuit 150 is formed of, for example, a regulator and the like.

The D/A converter unit 110 includes D/A converter circuits 11 to 18 and 81 to 88. Each of the D/A converter circuits 11 to 18 has the same configuration as the configuration of the D/A converter circuit 10 described in to FIG. 1. Each of the D/A converter circuits 81 to 88 has the same configuration as the configuration of the D/A converter circuit 80 described in FIG. 1. The driving unit 120 includes inverting amplifier circuits 21 to 28. Each of the inverting amplifier circuits 21 to 28 has the same configuration as the configuration of the inverting amplifier circuit 20 described in FIG. 1 and the like. The D/A converter circuits 11 to 18 convert the upper-bit data of the display data from the control circuit 180 from digital to analog and respectively output the voltage converted from digital to analog to the inverting amplifier circuits 21 to 28. The D/A converter circuits 81 to 88 convert the lower-bit data of the display data from digital to analog and respectively output the voltage converted from digital to analog to the inverting amplifier circuits 21 to 28. The inverting amplifier circuits 21 to 28 invert and amplify the voltage from the D/A converter circuits 11 to 18 with reference to the reference voltages from the D/A converter circuits 81 to 88, and then respectively output the data voltages VQ1 to VQ8 to the electro-optical panel 200.

The storage unit 160 stores various types of data (for example, setting data) used for controlling the display driver 100. The various types of data include setting data for setting an operation of the display driver 100, for example. The storage unit 160 is formed of a non-volatile memory, a RAM, or the like.

Figure 9:
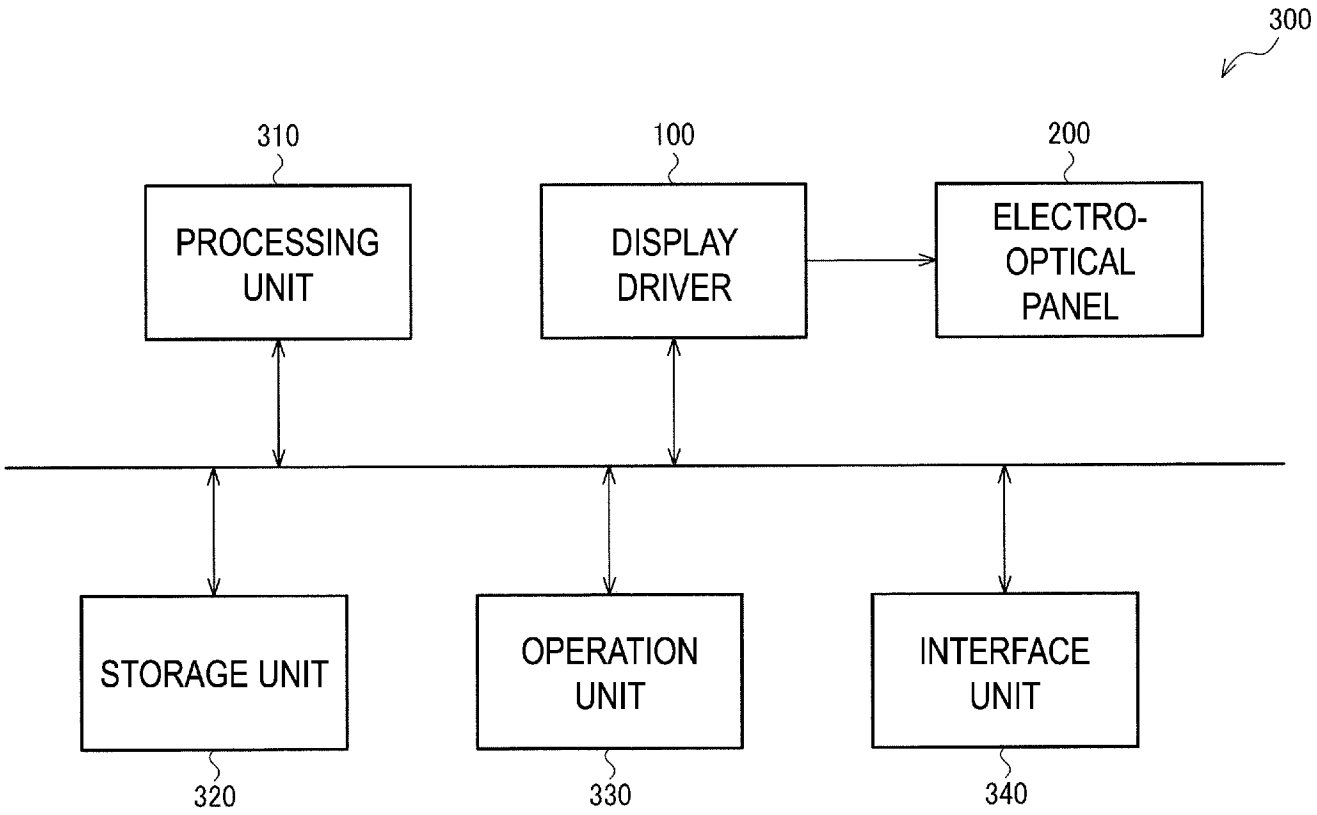
FIG. 9 illustrates a configuration example of an electronic apparatus.

FIG. 9 illustrates an example of a configuration of an electronic apparatus 300 including the display driver 100. Specific examples of the electronic apparatus 300 may include various electronic apparatuses on which a display device is mounted. The electronic apparatus 300 is, for example, a projector or a head-mounted display, a mobile information terminal, a vehicle-mounted device, a portable game terminal, an information processing device, and the like. The vehicle-mounted device is, for example, a meter panel, a car navigation system, or the like.

The electronic device 300 includes the processing unit 310, a storage unit 320, an operation unit 330, an interface unit 340, the display driver 100, and the electro-optical panel 200. The processing device 310 is, for example, a processor, such as a CPU, a display controller, an ASIC, or the like. The storage unit 320 is, for example, a memory, a hard disk, or the like. The operation unit 330 is also referred to as an operation device. The interface unit 340 is also referred to as an interface circuit or an interface device.

The operation unit 330 is a user interface configured to receive various operations from a user. For example, the operation unit 330 is a button, a mouse, a keyboard and a touch panel attached to the electro-optical panel 200, and the like. The interface unit 340 is a data interface configured to input and output image data and control data. The interface unit 340 is, for example, a wired communication interface such as a USB or a wireless communication interface such as a wireless LAN. The storage unit 320 stores data input from the interface unit 340. Alternatively, the storage unit 320 operates as a working memory of the processing unit 310. The processing unit 310 processes display data input from the interface unit 340 or stored in the storage unit 320 and then transfers the display data to the display driver 100. The display driver 100 displays an image on the electro-optical panel 200, based on the display data transferred from the processing unit 310.

For example, when the electronic apparatus 300 is a projector, the electronic apparatus 300 further includes a light source and an optical device. The optical device is, for example, a lens, a prism, a mirror, or the like. When the electro-optical panel 200 is of a transmissive type, the optical device causes light from the light source to be incident on the electro-optical panel 200, and the light transmitted through the electro-optical panel 200 is projected on a screen. When the electro-optical panel 200 is of a reflective type, the optical device causes light from the light source to be incident on the electro-optical panel 200, and the light reflected at the electro-optical panel 200 is projected on a screen.

According to the exemplary embodiment described above, a display driver includes a first D/A converter circuit, a second D/A converter circuit, and an inverting amplifier circuit. The first D/A converter circuit converts upper-bit data of display data into a gradation voltage corresponding to the upper-bit data. The second D/A converter circuit outputs a reference voltage that is varied in accordance with lower-bit data of the display data. The inverting amplifier circuit amplifies the gradation voltage with reference to the reference voltage, and drives a data line of an electro-optical panel. The second D/A converter circuit includes a first resistor, a second resistor, a reference voltage ladder resistance circuit, and a switch circuit. The first resistor is provided between a node of a high potential-side power source and an output node of the reference voltage. The second resistor is provided between the output node and a first node. The reference voltage ladder resistance circuit is provided between the first node and a node of a low potential-side power source. The switch circuit includes a plurality of switch elements provided between a plurality of output taps of the reference voltage ladder resistance circuit and the node of the low potential-side power source. The plurality of switch elements are turned on or off in accordance with the lower-bit data.

According to the exemplary embodiment, a voltage between the reference voltage and the low potential-side power source is divided by the second resistor and the reference voltage ladder resistance circuit, and the voltage being divided is output to the first node. In other words, a voltage of the first node is lower than the reference voltage. Accordingly, a breakdown voltage of the switch element constituting the switch circuit can be lower than a breakdown voltage of the transistor constituting the inverting amplifier circuit. Since the switch circuit can be formed by a low breakdown voltage process, a layout area of the second D/A converter circuit can be further reduced than that when the switch circuit is formed by the same high breakdown voltage process as that of the inverting amplifier circuit.

Further, in the exemplary embodiment, the second D/A converter circuit may include a switch signal generating circuit. The switch signal generating circuit may output a switch signal for turning on or off the plurality of switch elements, based on data in accordance with the lower-bit data.

According to the exemplary embodiment, the switch circuit can be formed by the low breakdown voltage process, thus the switch signal generating circuit that outputs a switch signal to the switch circuit can also be formed by the low breakdown voltage process. Accordingly, a layout area of the second D/A converter circuit can be reduced than that when the switch circuit and the switch signal generating circuit are formed by the same high breakdown voltage process as that of the inverting amplifier circuit.

Further, in the exemplary embodiment, the first D/A converter circuit and the inverting amplifier circuit may be formed of a transistor having a first breakdown voltage. The switch circuit and the switch signal generating circuit may be formed of a transistor having a second breakdown voltage that is lower than the first breakdown voltage.

Since the first D/A converter circuit needs to output a gradation voltage from an upper limit to a lower limit to the inverting amplifier circuit, the first D/A converter circuit and the inverting amplifier circuit are formed of transistors having the same breakdown voltage. On the other hand, since the second D/A converter circuit changes the reference voltage in accordance with the lower-bit data, a range of change in the reference voltage is small. At this time, the first D/A converter circuit has the configuration as described above, and thus the switch circuit and the switch signal generating circuit can be formed of the transistor having the second breakdown voltage that is lower than the first breakdown voltage.

Further, in the exemplary embodiment, the reference voltage ladder resistance circuit may include first to k-th resistors provided between the first node and the node of the low potential-side power source and coupled in series, where k is an integer greater than or equal to 2. The plurality of output taps of the reference voltage ladder resistance circuit may include first to k-th output taps. The j-th output tap may be a node at one end of the j-th resistor, where j is an integer greater than or equal to 1 and less than or equal to k.

As described above, the switch circuit includes the plurality of switch elements provided between the plurality of output taps of the reference voltage ladder resistance circuit and the node of the low potential-side power source. The plurality of switch elements are turned on or off in accordance with the lower-bit data, thus any of the plurality of output taps is coupled to the node of the low potential-side power source. The reference voltage is generated by a voltage being divided by the first resistor, the second resistor and the reference voltage ladder resistance circuit. A voltage division ratio varies depending on which output tap is coupled to the node of the low potential-side power source, thus the reference voltage in accordance with the lower-bit data can be output.

Further, in the exemplary embodiment, the plurality of switch elements of the switch circuit may include first to k-th switch elements. The j-th switch element may be provided between the j-th output tap and the node of the low potential-side power source.

According to the exemplary embodiment, when the j-th switch element is turned on, the j-th output tap and the node of the low potential-side power source are coupled with the j-th switch element. The switch signal generating circuit turns on any of the first to k-th switch elements in accordance with the lower-bit data, and thus any of the first to k-th output taps can be coupled to the node of the low potential-side power source. In this way, the reference voltage in accordance with the lower-bit data can be output.

Further, in the exemplary embodiment, the second D/A converter circuit may include a third resistor provided between one end of the reference voltage ladder resistance circuit and the node of the low potential-side power source.

The switch element that couples between the output tap of the reference voltage ladder resistance circuit and the node of the low potential-side power source has an on resistance. At this time, the resistor coupled between the output tap and the node of the low potential-side power source, and the switch element are coupled in parallel. A resistance value coupled in parallel to the switch element is varied depending on which output tap is coupled to the node of the low potential-side power source, which may cause the linearity of the reference voltage to decrease. According to the exemplary embodiment, the linearity of the reference voltage can be improved by providing the third resistor. In other words, by setting the resistance value of the third resistor higher than the on resistance of the switch element, the resistance value between the output tap and the node of the low potential-side power source is substantially an on resistance of the switch element. Accordingly, the linearity of the reference voltage can be improved.

Further, in the exemplary embodiment, a voltage of the first node may be lower than a power source voltage of the switch signal generating circuit.

A switch signal output to the switch element by the switch signal generating circuit has a signal level of the power source voltage of the switch signal generating circuit. Thus, when the voltage of the first node is lower than the power source voltage of the switch signal generating circuit, the voltage applied to the switch element is lower than the power source voltage of the switch signal generating circuit. As a result, the switch circuit and the switch signal generating circuit can be formed of a transistor having the same breakdown voltage.

Further, in the exemplary embodiment, the lower-bit data may be m bits, where m is an integer greater than or equal to 1, a gain of the inverting amplifier circuit may be G, and a voltage difference corresponding to one gradation of the gradation voltage may be $\Delta V$. At this time, the second D/A converter circuit may output a voltage corresponding to the lower-bit data as the reference voltage among $2^m$ voltages obtained by dividing a voltage between two voltages with $2^m$, the two voltages have a voltage difference being represented by $\Delta V \times |G|/(1+|G|)$.

According to the exemplary embodiment, the second D/A converter circuit outputs the reference voltage corresponding to the lower-bit data, and thus one gradation of the upper-bit data can be divided by $2^m$. Specifically, the inverting amplifier circuit can output the output voltage obtained by dividing the voltage difference $\Delta V$ corresponding to one gradation of the upper-bit data by $2^m$. Provided that a bit number of the upper-bit data is an n bit, multiple gradations for m bits with respect to the upper-bit data of n bits can be achieved.

Further, in the exemplary embodiment, an electro-optical device includes the display driver described in any of the descriptions above, and an electro-optical panel driven by the display driver.

Further, in the exemplary embodiment, an electronic apparatus includes the display driver described in any of the descriptions above.

Although some exemplary embodiments have been described in detail above, those skilled in the art will understand that many modified examples can be made without substantially departing from the novel matter and effects of the present disclosure. All such modified examples are thus included in the scope of the present disclosure. For example, terms in the descriptions or drawings given even once along with different terms having identical or broader meanings can be replaced with those different terms in all parts of the descriptions or drawings. All combinations of the exemplary embodiments and modified examples are also included within the scope of the present disclosure. Furthermore, the configurations and operations of the display driver, the electro-optical device, and the electronic apparatus are not limited to those described in the exemplary embodiments, and various modifications thereof are possible.

What is claimed is:

1. A display driver configured to drive an electro-optical panel including a data line, the display driver comprising:

a first D/A converter circuit configured to output a gradation voltage corresponding to upper-bit data of display data;

a second D/A converter circuit configured to output a reference voltage corresponding to lower-bit data of the display data; and an inverting amplifier circuit configured to amplify the gradation voltage with reference to the reference voltage, and to drive the data line of the electro-optical panel, wherein the second D/A converter circuit includes a first resistor provided between a node of a high potential-side power source and an output node of the reference voltage, a second resistor provided between the output node and a first node, a reference voltage ladder resistance circuit provided between the first node and a node of a low potential-side power source, and a switch circuit including a plurality of switch elements provided between a plurality of output taps of the reference voltage ladder resistance circuit and the node of the low potential-side power source, the plurality of switch elements being turned on or off in accordance with the lower-bit data.

2. The display driver according to claim 1, wherein the second D/A converter circuit includes a switch signal generating circuit configured to output a switch signal for turning on or off, based on data in accordance with the lower-bit data, the plurality of switch elements.

3. The display driver according to claim 2, wherein the first D/A converter circuit and the inverting amplifier circuit are formed of a transistor having a first breakdown voltage, and the switch circuit and the switch signal generating circuit are formed of a transistor having a second breakdown voltage being lower than the first breakdown voltage.

4. The display driver according to claim 2, wherein a voltage of the first node is lower than a power source voltage of the switch signal generating circuit.

5. The display driver according to claim 1, wherein the reference voltage ladder resistance circuit includes first to k-th resistors provided between the first node and the node of the low potential-side power source and coupled in series, k being an integer of 2 or greater, the plurality of output taps of the reference voltage ladder resistance circuit include first to k-th output taps, and the j-th output tap is a node at one end of the j-th resistor, j being an integer of 1 to k.

6. The display driver according to claim 5, wherein the plurality of switch elements of the switch circuit include first to k-th switch elements and the j-th switch element is provided between the j-th output tap and the node of the low potential-side power source.

7. The display driver according to claim 1, wherein the second D/A converter circuit includes a third resistor provided between one end of the reference voltage ladder resistance circuit and the node of the low potential-side power source.

8. The display driver according to claim 1, wherein the second D/A converter circuit is configured to output, as the reference voltage, a voltage corresponding to the lower-bit data, the voltage being among $2^m$ voltages obtained by dividing by $2^m$ a voltage between two voltages having a voltage difference represented by $\Delta V \times |G|/(1+|G|)$ wherein the lower-bit data are m bits, a gain of the inverting amplifier circuit is G, and a voltage difference corresponding to one gradation of the gradation voltage is $\Delta V$, m being an integer of 1 or greater.

9. An electro-optical device comprising:

the display driver according to claim 1; and an electro-optical panel configured to be driven by the display driver.

10. An electronic apparatus comprising:

the display driver according to claim 1.

* * * * *